United States Patent [19]

DePalma

[11] 3,958,950

[45] May 25, 1976

[54] COMPACT EXHAUST GAS CONVERTER WITH PULSE DAMPENING MEANS

[75] Inventor: Ted V. DePalma, Schaumburg, Ill.

[73] Assignee: Universal Oil Products Company, Des Plaines, Ill.

[22] Filed: Mar. 20, 1974

[21] Appl. No.: 453,128

[52] U.S. Cl. ..... 23/288 F; 23/288 FC; 181/36 C

[51] Int. Cl.[2] ..... B01J 8/00; B01J 8/02; F01N 3/15

[58] Field of Search ..... 23/288 F, 288 FC; 181/36 C, 57, 70; 60/299

[56] References Cited

UNITED STATES PATENTS

| | | | |
|---|---|---|---|
| 1,071,528 | 8/1913 | Rapp | 181/57 X |
| 1,366,632 | 1/1921 | Carlen | 181/70 X |
| 1,575,657 | 3/1926 | Straussler | 181/36 G UX |
| 2,071,119 | 2/1937 | Harger | 23/288 FC UX |
| 2,500,551 | 3/1950 | Kliewer | 181/57 X |
| 3,105,752 | 10/1963 | Bruce | 23/288 F UX |
| 3,180,712 | 4/1965 | Hamblin | 23/288 FB |
| 3,189,418 | 6/1965 | Gary | 23/288 FB UX |
| 3,201,338 | 8/1965 | Pennington | 23/288 FC UX |
| 3,276,202 | 10/1966 | Gary | 23/288 F UX |
| 3,567,403 | 3/1971 | Perga | 23/288 F |
| 3,644,098 | 2/1972 | DePalma et al. | 23/288 F |
| 3,695,851 | 10/1972 | Perga | 23/288 F |
| 3,749,130 | 7/1973 | Howitt et al. | 23/288 FC UX |
| 3,757,892 | 9/1973 | Raudman | 181/36 C |
| 3,780,772 | 12/1973 | Carnahan et al. | 23/288 FC UX |
| 3,817,714 | 6/1974 | Wiley | 23/288 FC |
| 3,852,042 | 12/1974 | Wagner | 23/288 FC |
| 3,867,105 | 2/1975 | Wagner | 23/288 F |

*Primary Examiner*—Barry S. Richman
*Attorney, Agent, or Firm*—James R. Hoatson, Jr.; Philip T. Liggett; Page, II: William H.

[57] ABSTRACT

A compact cylindrical-form or ball-shaped exhaust gas converter is provided with a hemispherical-form inlet end housing section to provide a gas expansion space around a perforated interior partition which, in turn, is maintained a spaced distance from such housing section to extend from the gas inlet port to a zone adjacent the upstream end of the centrally positioned catalyst retaining section. This special gas inlet construction serves as a gas pressure amplitude modulator to average or dampen pulsations in the exhaust gas stream from an internal combustion engine so as to substantially eliminate damage to the catalyst being maintained in the converter.

3 Claims, 2 Drawing Figures

COMPACT EXHAUST GAS CONVERTER WITH PULSE DAMPENING MEANS

Figure 2:
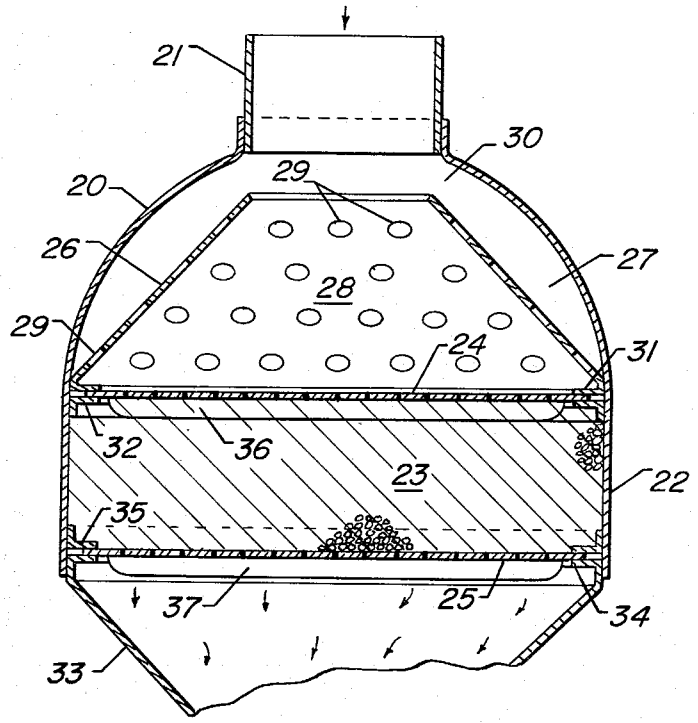

The present invention relates to an improved type of compact cylindrical-form or ball-shaped catalytic converter by providing a special pulse dampening gas inlet end section.

More especially, the improved converter has an enlarged, hemispherical-form inlet housing portion to provide a gas pulse absorbing space, or expansion chamber, around an internal perforated partition which generally defines the gas passageway between the exhaust gas inlet port and the upstream zone of the catalyst retaining section.

In connection with internal combustion engines, the exhaust gas flow has pulsations which can create problems for the catalyst beds in catalytic converters. The pulsations actually produce pressure peaks and accompanying pressure surges which can act on the catalyst bed to, in turn, cause breakage of individual particles in a bed. On the other hand, where there is some provision to absorb the pressure peaks and the pulsating volumes of exhaust gas such that the same volume of gas can, in effect, flow at a uniform rate through the catalyst bed to provide a uniform pressure drop, then there is eliminated the problem of catalyst breakage from pulsations and vibrations, particularly where small pellets or particles are used and can be pushed against one another.

Thus, it may be considered a principal object of the present invention to provide a catalytic converter design which has pressure amplitude modulating means such that there is a more even flow through the catalyst bed of the converter.

It may also be considered an object of the present invention to provide a simplified cylinder or ball-form construction for a catalytic converter, including a generally inexpensive design and arrangement for a pulse modulating gas inlet section. Additionally, as heretofore noted, the improvement substantially eliminates damage to small, subdivided catalyst particles which may be utilized in the catalyst section of the converter.

In a broad aspect, the present invention provides in an internal combustion engine exhaust gas converter having opposing inlet and outlet means to channel the exhaust gas stream through a catalyst bed retained between spaced apart generally transverse perforated partitions; the improved construction and arrangement to dampen pulsations in the gas stream and substantially eliminate damage to the catalyst in said bed which comprises, providing a hemispherical-form outer housing portion for the gas inlet end section, and further providing an interior perforated partition that is spaced away from the interior wall of said hemispherical-form housing portion to define a gas expansion space therebetween and also define an enlarging cross-sectional area gas inlet passageway leading to the inlet face of said catalyst bed.

The interior baffle or partition may be of a generally hemispherical shape or of other dome configuration such as frustoconical, as long as it is spaced from the interior of the housing portion and provides the desired space to absorb pressure surges. An upstream end of the perforate partitioning means may actually connect with the gas inlet port means or it may be spaced slightly away therefrom such that some exhaust gas flow may pass directly behind the partition rather than pass entirely through perforations in the partition.

Also, preferably the partitioning will be of a widening cross-sectional area configuration to define the principal gas inlet passageway to the zone of the inlet face of the catalyst bed. In other words, the partition may be of a generally hemispherical-form with a lesser radius than that of the circumscribed inlet housing portion or it may be of a generally frustoconical configuration with the small diameter portion connecting to or placed closely adjacent the inside of the gas inlet port means and the downstream face connecting to or terminating closely adjacent the inlet face portion of the catalyst section.

The present improved construction and arrangement is of particular advantage for storing the high pressure surge of a gas pulsation and then effecting a release of the pressure during the low pressure portion of the gas pulse from the internal combustion engine such that the catalyst will be exposed to a gas pulsation amplitude which is generally modulated and averaged. Also as heretofore noted, the advantage obtained in modulating exhaust gas pressure pulses is of particular advantage in connection with the use of small subdivided catalyst particles being retained in the catalyst section of a converter unit; however, it may also be of advantage to dampen and modulate gas pulsations with converters utilizing the coated honeycomb type of ceramic materials as catalyst elements.

Reference to the accompanying drawing and the following description thereof will serve to illustrate how a hemispherical-form inlet housing portion, together with internal partitioning, can provide a compact type of converter with pulse absorbing means and in addition point out other advantageous features obtained from the modified overall construction and arrangements.

Figure 1:
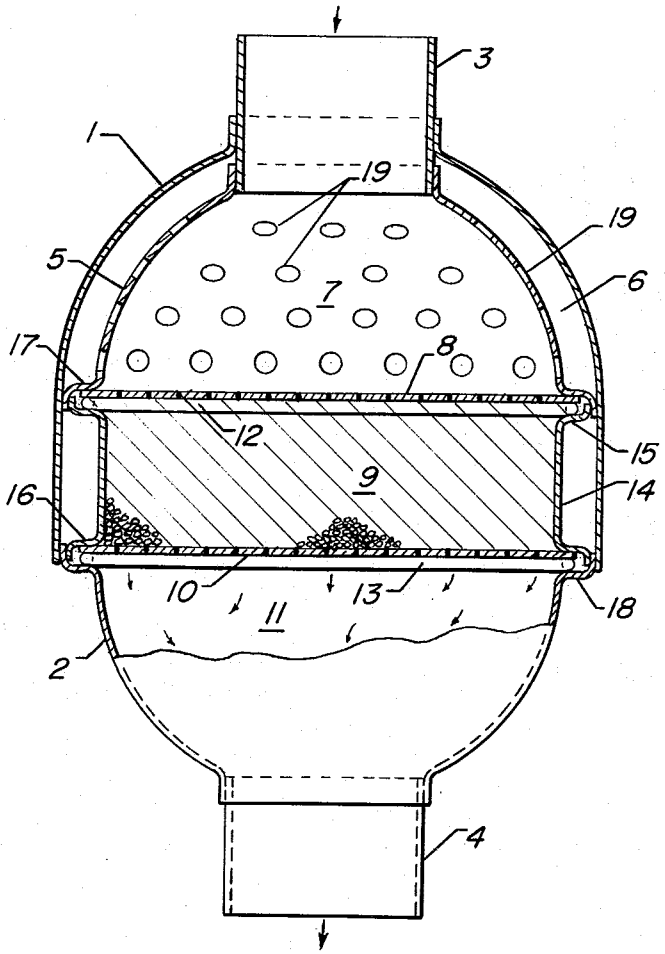

FIG. 1 of the drawing diagrammatically illustrates a sectional elevational view of a compact ball-shaped converter unit having both a hemispherical housing portion and a hemispherical-form interior perforate partition at the inlet section.

FIG. 2 of the drawing illustrates a sectional elevational view of a modified compact form of converter unit with a frustoconical perforated partitioning member spaced interiorly from a hemispherical-form housing portion for the inlet section of the converter.

Referring now particularly to FIG. 1 of the drawing, there is indicated a converter with a hemispherical-form housing portion 1 encompassing the inlet section of the converter as well as the central portion thereof. In addition, a generally hemispherical-form portion 2 is provided for the housing portion at the outlet end of the converter. A short section of piping or tubing 3 extends into the end portion of housing section 1 to serve as gas inlet port means while at the same time, a short section of tubing 4 connects with the end of housing outlet section 2 so as to provide an outlet port means. In accordance with the present invention, a perforate partition or baffle member 5 is spaced from the hemispherical housing portion 1 within the gas inlet section of the converter to provide a gas pulse absorbing spacing 6 therebetween and at the same time define a gas inlet plenum section 7 leading up to perforate plate member 8 which defines the upstream face of a catalyst section 9. A downstream face of the catalyst section is, in turn, defined by perforate plate member 10 such that the treated gas stream can pass into an unobstructed outlet plenum section 11 and thence outwardly through the discharge port at 4.

Various construction methods may be utilized to define the interior catalyst retaining section of a converter unit and it is not intended to limit the present invention to any one type of catalyst or to any one type of catalyst retaining section. In FIG. 1, both the inlet and outlet perforate plates, or screen members, 8 and 10, are indicated as having stiffener ribs such as 12 and 13 to assist in providing strength and rigidity to overcome pressure pulsations. There is also indicated the use of an internal cylindrical-form member 14 with slightly larger diameter flange member 15 and 16 to provide spaced apart sliding support portions for the respective catalyst support plates 8 and 10. Around the exterior face of perforate plate member 8, there is also an outwardly extending flange portion 17 for the hemispherical-form partitioning member 5 such that there is a groove or recess formed to permit the expansion and contraction of plate 8 and its attached reinforcing rib portions 12. In a similar manner, the large diameter portion of outlet housing portion 2 is provided with an outwardly projecting flange section 18 which is connective with the lower extremity of housing section 1 and such flange 18 assists in defining a groove or recess to accommodate the expansion and contraction of the downstream perforate plate member 10 and its reinforcing rib means 13. The catalyst within section 9 is indicated as being of subdivided particles and preferably of spherical form so as to have the maximum amount of strength and resistance to breakage.

In the present embodiment, the upper or inlet end portion for partitioning 5 is indicated as connecting with the interior end portion of gas inlet tube 3 such that all of the engine exhaust gases will enter the plenum zone 7 as defined by the perforate plate member 5, and high pressure pulsations will cause gas flow through the multiplicity of holes or openings 19 into the space 6 and against the interior wall of housing portion 1. During the operation of the converter unit, as the high pressure pulsation decreases in intensity, the stored gas pressure from zone 6 will be released back into the plenum zone 7 to pass on through perforate plate 8 and into the catalyst section 9. The overall result is the modulation or averaging of the pressure pulses so as to provide a more uniform pressure, and rate of flow, through the catalyst zone 9 and into the outlet portion of the converter. The number of holes and the sizing of holes 19 can vary in accordance with the size of the particular catalyst converter and with the size of the engine being accommodated by the particular converter.

The use of an external hemisphere or dome portion 1 to encompass the pressure absorbing zone 6 is of particular advantage in that a domed or hemispherical configuration provides optimum strength while minimizing expansion and contraction problems from temperature changes. The same observation may be made with respect to the interior partitioning member 5 in that the pressure and expansion problems are minimized with the spherical-form configuration. It is also to be noted that with existing converters having a conical or domed shape for the inlet gas portion thereof may be provided with an added hemispherical-form shroud or housing, of the nature of portion 1 in FIG. 1 of the drawing, such that there is a resulting space around the original housing portion to provide a desired pulse absorbing zone and effect exhaust gas pressure modulation. In effecting a modification to a converter, it will, of course, be necessary to drill holes in the original housing portion prior to encompassing it and forming a gas storage portion, such that there may be the desired gas flow back and forth from such encompassing pressure storing zone.

With reference to FIG. 2 of the drawing, there is indicated a converter unit having a hemispherical-form housing or shroud portion 20 with inlet tube means 21 and a cylindrical wall portion 22 which defines a catalyst retaining space 23. The latter is further defined by an upstream perforate plate member 24 and the outlet perforate plate member 25 such that catalyst spheres or other form of catalyst may be retained within the section 23. It will be noted that the present embodiment differs from that previously shown and described by virtue of having a frustoconical form of interior partitioning 26 to define a gas storage space 27 and an increasing diameter gas passageway zone 28 carrying up to the inlet face of the catalyst section at perforate plate 24. The entire surface area of the partitioning member 26 is provided with a plurality of holes or openings 29, in a manner similar to that provided for the hemispherical partition member 5 of FIG. 1; however, in the present instance, it will be noted that the upstream end of the conical section 26 does not connect with the inlet tube means 21 and exhaust gas flow can, in part, be diverted into the encompassing pressure absorbing space 27 rather than all flow through openings 29. In other words, gas storage and pulse absorption may be obtained through the annular space at 30 adjacent the upstream periphery of partition 26, as well as through the multiplicity of holes 29.

Various types of construction and arrangements can be utilized to hold the catalyst retaining plate members 24 and 25 within the interior of the converter unit. In the present arrangement, there is a flange means 31 on the downstream end portion of partition 26 and it cooperates with the use of support angle means 32, which extends around the inside wall of cylindrical housing section 22, to slidably hold plate member 24. In a similar manner, the lower outlet housing portion 33 is provided with inwardly extending flange means 34 so as to cooperate with a support angle means 35 to provide a recess or groove for the slidable support of perforate plate 25. Both the perforate plates 24 and 25 are, in turn, shown as being provided, respectively, with suitable stiffening rib means 36 and 37 such that they can accommodate pressure pulsations from the gas flow and at the same time be free to expand and contract radially in accordance with temperature fluctuations within the converter. It is generally known that catalytic converter units will undergo wide fluctuations of temperature from cold engine, atmospheric temperature conditions, up to conversion temperatures of the order of 1200° to 1400°F. or higher after long periods of engine operation.

Although the hemispherical-form and frustoconical form partitioning are believed to be of structural advantage for the perforated baffle member within the inlet section of the converter, it is not intended to limit the present invention to those identical shapes inasmuch as other domed configurations may well be utilized to advantage as long as there is suitable pressure storage space provided around the baffle and inside the hemispherical-form or domed-form of housing which encompass the gas inlet portion of the unit.

In another aspect, it is not intended to limit the improved construction and arrangement to any one type of catalyst nor to any one form of catalyst retaining plates and plate holding means in connection with the construction of the catalyst section. Also, the present drawings are not intended to be complete in all aspects in that neither of the present embodiments indicate catalyst fill plugs, thermocouple connections, etc., which may be normally desirable for control of the converter operation and in order to provide means for filling and/or replacing catalyst from within the interior catalyst section. Where rigid catalyst elements are to be utilized, then suitable removability of an end section may be provided to, in turn, provide access to the interior of the catalyst section and permit interchangeability of a catalyst element within the converter unit. Although not shown, where desired for protective purposes, or for heat retention, insulation and insulation holding means may be provided for all or a part of the exterior of the converter.

I claim as my invention:

1. In an internal combustion engine exhaust gas converter having opposing inlet and outlet means to channel the exhaust gas stream through a catalyst bed retained between spaced apart generally transverse perforated partitions, the improved construction and arrangement to dampen pulsations in the gas stream and substantially eliminate damage to the catalyst in said bed which comprises in combination, a hemispherical-form housing portion in interconnection with said gas inlet end of said converter, and an internal, upstream, transverse perforated partition within and spaced from said hemispherical-form housing, said internal upstream perforated partition having a large unobstructed upstream opening in alignment with said converter inlet means to receive the exhaust gas stream therefrom and an increasing diameter in the direction of the gas flow from the converter inlet means, said internal upstream, perforated partition terminating at and abutting the transverse perforated partition located upstream at the face of said catalyst bed in said converter, said internal upstream perforated partition of increasing diameter being shaped and sized such that the greater part of its outer wall surface is spaced inwardly away from the inside surface of said hemispherical-form housing portion to form a tapering annular-form gas pulse absorbing space therebetween, and to define within said internal upstream perforated partition an enlarging gas inlet plenum section leading to said catalyst bed, said internal upstream perforated partition permitting gas flow outwardly into said pulse absorbing space, whereby to thus dampen said pulsations in the gas stream.

2. The exhaust gas converter of claim 1 further characterized in that the upstream end portion of said internal upstream perforated partition is in interconnection with said inlet means to the converter whereby gas flow into and out from the gas expansion space is entirely through the perforations of said internal upstream perforated partition.

3. The exhaust gas converter of claim 1 further characterized in that the upstream end portion of the internal perforated partition is spaced from said inlet means to the converter whereby at least a portion of the exhaust gas stream flow may pass directly into said gas expansion space without entirely passing through the perforations of said internal upstream perforated partition.

* * * * *